United States Patent [19]

Stauff et al.

[11] 4,149,686

[45] Apr. 17, 1979

[54] METHOD AND APPARATUS FOR GUIDING A ROTATING MOVING BODY

[75] Inventors: Emile Stauff, Versailles; Gilbert Vallas, Croissy-sur-Seine, both of France

[73] Assignee: Electronique Marcal Dassault, France

[21] Appl. No.: 678,382

[22] Filed: Apr. 19, 1976

[30] Foreign Application Priority Data

Jan. 27, 1976 [FR] France ..... 76 02114

[51] Int. Cl.[2] ..... F42B 15/10; F42B 15/02; F41G 7/00

[52] U.S. Cl. ..... 244/3.16; 244/313

[58] Field of Search ..... 244/3.13, 3.16

[56] References Cited

U.S. PATENT DOCUMENTS

| | | | |
|---|---|---|---|
| 3,690,594 | 9/1972 | Menke | 244/3.13 |
| 3,746,280 | 7/1973 | Coxe et al. | 244/3.13 |
| 3,782,667 | 1/1974 | Miller, Jr. et al. | 244/3.13 |
| 3,964,053 | 6/1976 | Heiser | 244/3.13 |

*Primary Examiner*—Samuel W. Engle
*Assistant Examiner*—Thomas H. Webb
*Attorney, Agent, or Firm*—Wenderoth, Lind & Ponack

[57] ABSTRACT

The present invention is a method and an apparatus for guiding a rotating moving body to keep it on course towards a target, this method and apparatus comprising emitting electromagnetic radiation, with the aid of a radiation emitter having a variable-focus optical system enabling the body to be followed during its flight, having a very short wave length and in the form of a beam which is amplitude modulated in such a way that different areas over a cross section of the beam in a plane passing through the body being guided contain respectively radiation of high and low intensity, sweeping this beam with at least one radiation detector mounted on the body being guided and calculating, from the signals emitted by one or more detectors, the data necessary for automatically guiding the body along an axis extending between the center of the amplitude modulated beam and the target.

12 Claims, 9 Drawing Figures

METHOD AND APPARATUS FOR GUIDING A ROTATING MOVING BODY

The present invention relates to a method and apparatus for guiding a rotating moving body to keep it on course towards a target. In particular the invention enables a body in the form of a projectile to be controlled to guide it on course along an axis directed towards the target.

The guiding of projectiles, particularly missiles, is at present ordinarily carried out by apparatus comprising one or more gyroscopes. Such apparatus is not entirely satisfactory particularly as it does not permit rapid acceleration, and this limits the velocity at which the projectile leaves the launching station or launching tube, and increases initial dispersion and the duration of flight.

According to one aspect of this invention, there is provided a method for guiding a rotating moving body to keep it on course towards a target, this method comprising emitting electromagnetic radiation, with the aid of a radiation emitter having a variable-focus optical system enabling the body to be followed during its flight, having a very short wavelength and in the form of a beam which is amplitude modulated in such a way that different areas over a cross section of the beam in a plane passing through the body being guided contain respectively radiation of high and low intensity, sweeping this beam with at least one radiation detector mounted on the body being guided and calculating, from the signals emitted by one or more detectors, the data necessary for automatically guiding the body along an axis extending between the center of the amplitude modulated beam and the target.

In one embodiment of the invention, the cross section of the beam comprises a plurality of circular rings, the radii of the various circles being $$a=k^n l,$$

in which formula 1, 2, 3 . . . $k$ is a succession of whole numbers, n is an exponent approximating 1, and $l$ is a length.

According to a further aspect of the invention, there is provided an apparatus for guiding a rotating moving body to keep it on course towards a target, this apparatus comprising a radiation emitter located on the launching station of the body to be guided for emitting very short wavelength electromagnetic radiation in the form of a beam which is amplitude modulated in such a way that different areas over the cross section of the beam in a plane passing through the body being guided contain respectively radiation of high and low intensity, this emitter being provided with a variable-focus optical system enabling the body to be followed during its flight; at least one detector mounted on the body being guided so as to sweep across the beam, the one or more detectors taking the form of an electro-optical detector including a converging lens, at the focal point of which is placed a cell which is sensitive to the intensity of the electro-magnetic radiation, and means provided in the body for analyzing the output signal of the cell so as to determine the distance of the body from the axis of the beam and the time derivative of this distance, and for correcting the trajectory of the body on the basis of such analysis.

In order that the invention may be better understood, several embodiments thereof will now be described by way of example only and with reference to the accompanying drawings in which.

Figure 1:
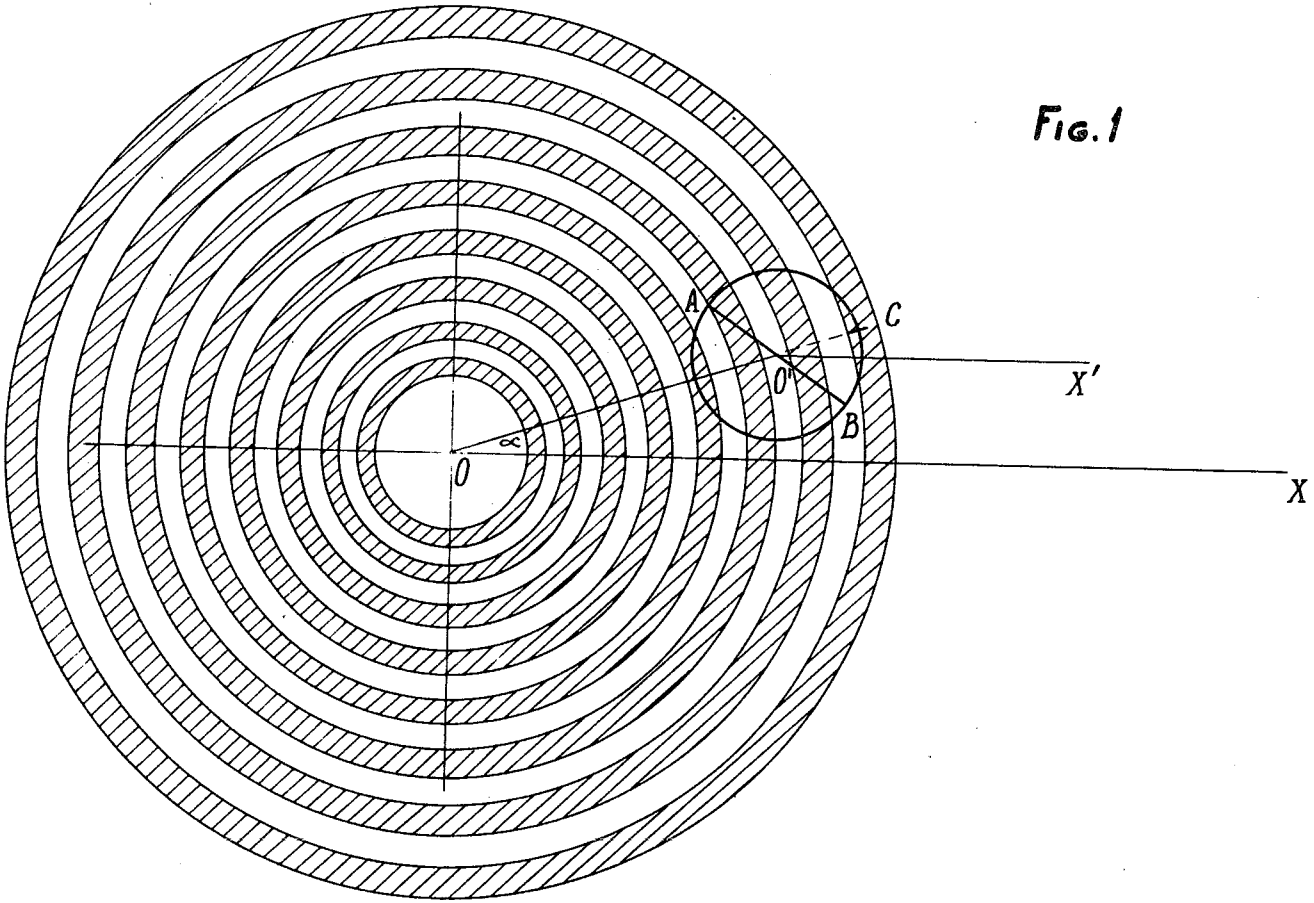
FIG. 1 is a cross section through one form of the beam emitted by the electromagnetic radiation emitter, taken on a plane passing through the body being guided.
Figure 2:
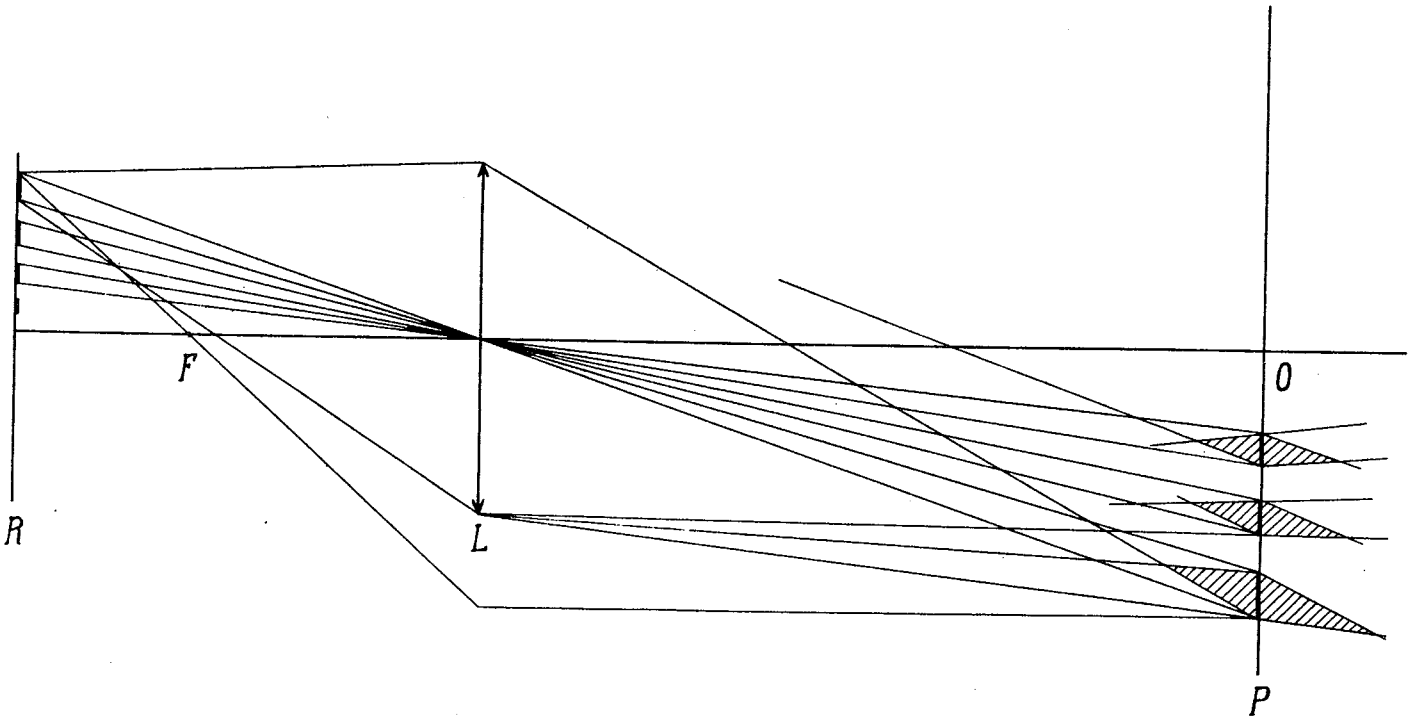
FIG. 2 is a view of one embodiment of part of a radiation emitter whereby the beam of FIG. 1 can be obtained.

Referring first to FIGS. 1 and 2, the beam used in this first example is formed in a plane P at a distance D from a radiation emitter (not shown) provided on the projectile launching system, which emitter emits electromagnetic radiation of very short wavelength in the form of an amplitude modulated beam comprising a series of concentric circular rings. These rings represent, alternately, high radiation intensities and low radiation intensities, the low radiation intensities approximating zero. The line joining the center O of the concentric circles defining the rings forms, with the emitter, the axis of the beam.

If 1, 2, 3 . . . k form a succession of whole numbers, and if n is an exponent approximately equal to 1 (in fact a value in excess of 1 will be selected so that the distances between the circles increase with k) and if l is a length, the radii of the circles defining the rings are given by:

$$a=k^n l$$

It is of course possible to select a different rate of increase, which however leads to gaps which increase with k; for example, one value of n for low values of k, and another value of n for high values of k.

The beam may be amplitude modulated by depositing, on the outer face of the semi-reflecting glass of a laser resonance chamber (not shown), a metallic reflecting coating which reproduces the pattern of the rings. In this way a grid R is formed, as shown in FIG. 2, the radiation image of which is formed on plane P.

If desired, a metallic semi-reflecting coating may be deposited on the inner face of the glass of the laser resonance chamber. In this case, it is desirable, for the purpose of avoiding, as far as possible, any disturbance affecting the laser, to select a thickness of glass that results in the establishment of a system of standing waves between the two metallic layers, taking into account the fact that the vibration node is within the metal.

It is necessary that an image of the grid R is always formed in a plane passing through the projectile as the projectile moves towards its target, and this is ensured by passing the radiation through a variable-focus optical system. For the purpose of simplification, the optical system is shown in FIG. 2 in the form of a single lens L, means being provided for obtaining an image of predetermined dimensions at various distances from the grid R.

The aperture of the optical system should be such that filtering of the image is acceptable at the distances in question.

It is also advantageous to provide means for correcting geometrical aberrations; it is in fact the existence of these aberrations as well as of diffraction which imposes a minimum gap between two adjacent circles for any given distance between the grid R and plane P.

If the rings of low radiation intensity have an intensity other than zero, then steps should be taken to ensure that this radiation differs in phase by $\pi$ radians with respect to the phase of the radiation within the rings of high radiation intensity, so as to reduce the effect of diffraction.

It can be shown that, for a fixed setting of the optical system, there exists an image similar to that existing in the plane P, in the space in front of and to the rear of the plane P, up to distances depending upon the relationship between the gap between two adjacent circles and the diameter of the outlet aperture of the system. However, if light radiation is emitted the change in radiation intensity is more progressive. Outside these zones extinction no longer occurs in the effective zone of the field. The emitter of such a beam, equipped with its variable focus optical system, can be used as a telemeter. However, the results are less accurate than those obtained with laser telemeters. This system also makes it possible to verify that the axis of the beam and the crossed-line grid on the television camera are lined up.

If there is placed in the plane P a radiation detector in the form of an electro-optical detector, for example a converging lens, at the focal point of which is located a cell sensitive to the intensity of the electromagnetic radiation, the cell will detect a change when it passes from one ring to another along the plane P. Advantageously the detector is provided with a filter which lets through only monochromatic radiation from the emitter.

The rotating body or the automatically rotating projectile that is to be guided is provided with one or more radiation detectors of this kind. The detectors sweep the beam by rotating about an axis approximately parallel to the axis of the beam at an angular velocity of $$\omega = 2\pi N = \frac{d\theta}{dt},$$

wherein

N is the number of revolutions per second of the rotating body, $\omega$ is the instantaneous speed of rotation of the body, and $\theta$ is a reference angle (see below).

Analysis of the output signals of the radiation detector enables the distance between the projectile and the axis of the beam and the time derivative of this distance to be determined, the results of this analysis being used to correct the trajectory of the projectile.

In the example illustrated in FIG. 1, the rotating body takes the form of an automatically rotating projectile and carries two radiation detectors A and B located one at each end of a diameter of a circle whose center O' represents the axis of rotation of the body.

Let it be assumed that:

$AB=2r$ $OO'=\rho$ $$v = \frac{d\rho}{dt}$$

OX is a reference axis fixed in space,

O'X' is the axis parallel to OX passing through O', $\alpha=\widehat{OX, OO'}$ $\theta=\widehat{O'X', O'A}$ If $\theta_k$ is the angle corresponding to the intersection of the circle at position k, or the "iso k" circle, it can be established that:

$$\theta_k - \alpha = \arccos \frac{k^{2n}\rho^2 - \rho^2 - r^2}{2r\rho}$$

The case where $\alpha=0$ will first be analyzed, C being taken as the point $\theta=0$ when $\alpha=0$.

It can be shown that the number of "iso k" circles bisected by electro optical detectors A and B during revolution through 180° is, with very good approximation, independent of v and is solely a function of $\rho$ (except when $\rho\sim 0$). Connoting this given factor by the symbol $\nu$, we have:

$$\rho \approx \left(\frac{4r}{nl\frac{1}{\pi}v}\right)^{\frac{n}{n-1}} \tag{1}$$

If $\Delta\nu$ is the algebraic difference between the number of bisections of the rings of the network, recorded by detector A when it rotates from 0° to 180°, and the bisections recorded by detector B in the same period, it can be stated to a good approximation that:

$$v = -\frac{\Delta\nu}{\nu}\cdot 4\,r\,N \tag{2}$$

By totalling the three successive angles (or the times that elapse between four successive bisections), it is found that this total has:

a large maximum when $\theta\approx 0$, a generally smaller maximum when $\theta\approx 180°$, particularly when $\rho$ is not too great, and an absolute minimum when $\theta=\pm 90°$.

By taking the mean for the central bisection when the total is a maximum, it is possible to determine the non-oriented straight line for 0° to 180° and to determine $\Delta\nu$.

When $\rho$ is not too great in relation to r, the point C in FIG. 1 corresponding to $\theta=\alpha$ (and $\theta=O$ when $\alpha=0$) is thus determined at the same time.

When $\rho$ becomes too great in relation to r, the maximum at $\theta=\alpha+180°$ may reach and even exceed the level of the maximum at $\theta=\alpha$ for certain values of $\rho$. Then, the velocity calculated on the basis of equation (2) is compared with the velocity deduced from the change in $\nu$ in dependence upon $\rho$. It is thus possible to remove ambiguity for when the ratio ($\rho/r$is large.

Other measurements also enable $\rho$ and v to be determined.

It can be shown that if $T_1$ is the time that elapses between two bisections when the total of the three bisections is a minimum for when one of the electro-optical detectors turns for 0° to 180°, and $T_2$ is the bisection time for the other detector, then:

$$\frac{1}{T_1} + \frac{1}{T_2}$$

is independent of v and is solely a function of $\rho$.

On the other hand, $$\frac{1}{T_1} - \frac{1}{T_2}$$

is proportional to $-v$ and $$\frac{T_1 - T_2}{T_1 + T_2} = \frac{v}{r\omega} \quad (3)$$

It has been seen above that when $v=0$, the reference angle $\theta=\alpha$ is obtained from the mean of the central bisection for three intervals representing a maximum duration. When v is no longer negligible, it is necessary to make a correction of $$-\frac{v}{\omega}\left(\frac{1}{r} + \frac{1}{\rho}\right) \text{radians}$$

which, since it is a corrective term, can be compared with $(v/\omega r)$ which, in accordance with equation (3), is equal to $$\frac{T_1 - T_2}{T_1 + T_2}$$

or, in accordance with equation (2), is equal to $$\frac{2}{\pi}\ \frac{\Delta v}{v}.$$

When guiding an automatically rotating projectile, it is necessary to provide a time base in the projectile. In particular it is necessary to know from this time base the time required by the projectile to execute one revolution. When $$\frac{d\alpha}{dt} \approx 0,$$

this time is the period that elapses between two successive main maxima, or twice the period that elapses between two successive minima. In the case of high-velocity projectiles and when N is in the order of 10 revolutions per second, $$\frac{d\alpha}{dt}$$

will be negligible.

Assume therefore that the projectile is provided with a time base, though it should be stated that it is not necessary for this time base to be precise and that it suffices for it to be relatively stable during the duration of the flight of the projectile.

Using this time base, a measurement is made of the time corresponding to three successive intervals and from this are calculated the moments $\tau_1$, $\tau_2$, $\tau_3$ etc. corresponding to the successive main maxima. The times $$\tau_2 - \tau_1 = T_1$$

$$\tau_3 - \tau_2 = T_2 \text{ etc. . . .}$$

are the times necessary for one revolution to take place. These times only vary slowly in dependence upon the speed of flight. The number of "iso k" circle crossings by A from 0° to 180°, $\nu_1$, and the number of crossings by B in the same period, $\nu_2$, i.e. from 180° to 360° are measured. From these measurements there are calculated the following:

$$\nu = \nu_1 + \nu_2 \text{ and } \Delta\nu = \nu_1 - \nu_2$$

as well as $$\rho = \left(\frac{}{n1\ \frac{1}{n}\ v}\right)^{\frac{n}{n-1}} \text{ and}$$

$$v = -\frac{\Delta v}{v}\ 4rN = -\frac{\Delta v}{v}\ \frac{4r}{T}$$

If $$\frac{d\alpha}{dt}$$

is not negligible, it is necessary to measure the speed of rotation $\omega$. This can be done by providing the projectiles with two identical accelerometers which are disposed symmetrically about the main longitudinal axis of inertia and each at a distance d from this axis. Half of the sum of their measurement gives $\omega^2$, from which is calculated $$\omega = \frac{d\theta}{dt};$$

a time base enables $$\frac{d\alpha}{dt}$$

to be determined from this value.

To offset the speed of rotation of the projectile about its axis 0, it is necessary to shift the signals by an amount $$\delta_1 = \frac{d\alpha}{dt}\ \frac{\rho}{v}.$$

It is also possible to shift the signals by a fixed amount $\delta_2$ to take into account the time-lag which occurs between the moment when the electrical signal is sent to the projectile and the moment at which the signal is obeyed, for example by the rudder of the projectile (slowing down of the rudder), and the signals may also be shifter through $\delta_3$ to offset the gyroscopic effect.

To simplify the explanation let it be supposed that:

(a) the rudder of the projectile is operated on an "all or nothing" basis. Under these conditions the moment of the rudder is proportional to the period during which the guide is actuated, provided that angles much greater than $(\lambda/2)$ are not scanned;

(b) the projectile is only provided with a rudder in one plane; this requirement is not essential, but in view of the speeds of rotation that are envisaged, it enables the projectile to be correctly guided;

(c) the instantaneous moment of the rudder is in the plane AB; and (d) a control rate $$\lambda = f(\rho, v)$$

has been established, taking into account a more of less considerable smoothing of $\rho$ and v. It is quite clear that the number of signals sent per second increases with N and with the number of detectors provided on the projectile.

If, for example, it is supposed that the moment of the rudder has to be directed towards O, the instant at which the position i signal is initiated as:

$$t_i = \tau_i + \frac{T}{2} - \frac{\lambda}{2} - \delta$$

and the instant at which the position i signal terminates is:

$$t'_i = \tau_i + \frac{T}{2} + \frac{\lambda}{2} - \delta$$

$\delta$ being the algebraic sum of the accelerations or decelerations that are required to be taken into account (particularly $\delta_1$, $\delta_2$ or $\delta_3$).

It will be seen from the foregoing theoretical explanation that the combination of a radiation emitter, producing a beam as described, and of one or more radiation detectors provided on the rotating body enables the body to be guided along a required trajectory. Additionally the emitted beam can be used for aiming a weapon and measuring the distance to the target.

In accordance with a further embodiment, use is made of a beam of electromagnetic radiation constituted by a pattern of bands which are preferably of equal width and which define alternately areas of high and low radiation intensity, this pattern being obtained by dividing a plane P, located at a distance D from the radiation emitter, into $\mu$ equal angular sectors, having as their center the line O of the axis of the beam in this plane, $\mu$ preferably being an even whole number, and by providing on the $\mu$ bisections of the sectors a plurality of points $M_1, M_2, \ldots M_k$ so arranged that:

$$OM_1 = M_1M_2 = \ldots M_{K-1}M_K = d;$$

and by running, from said points, lines parallel to the straight lines that delimit the angular sectors, the beam so obtained being rotated about its axis in the direction opposite to that in which the projectile rotates.

Figure 3:
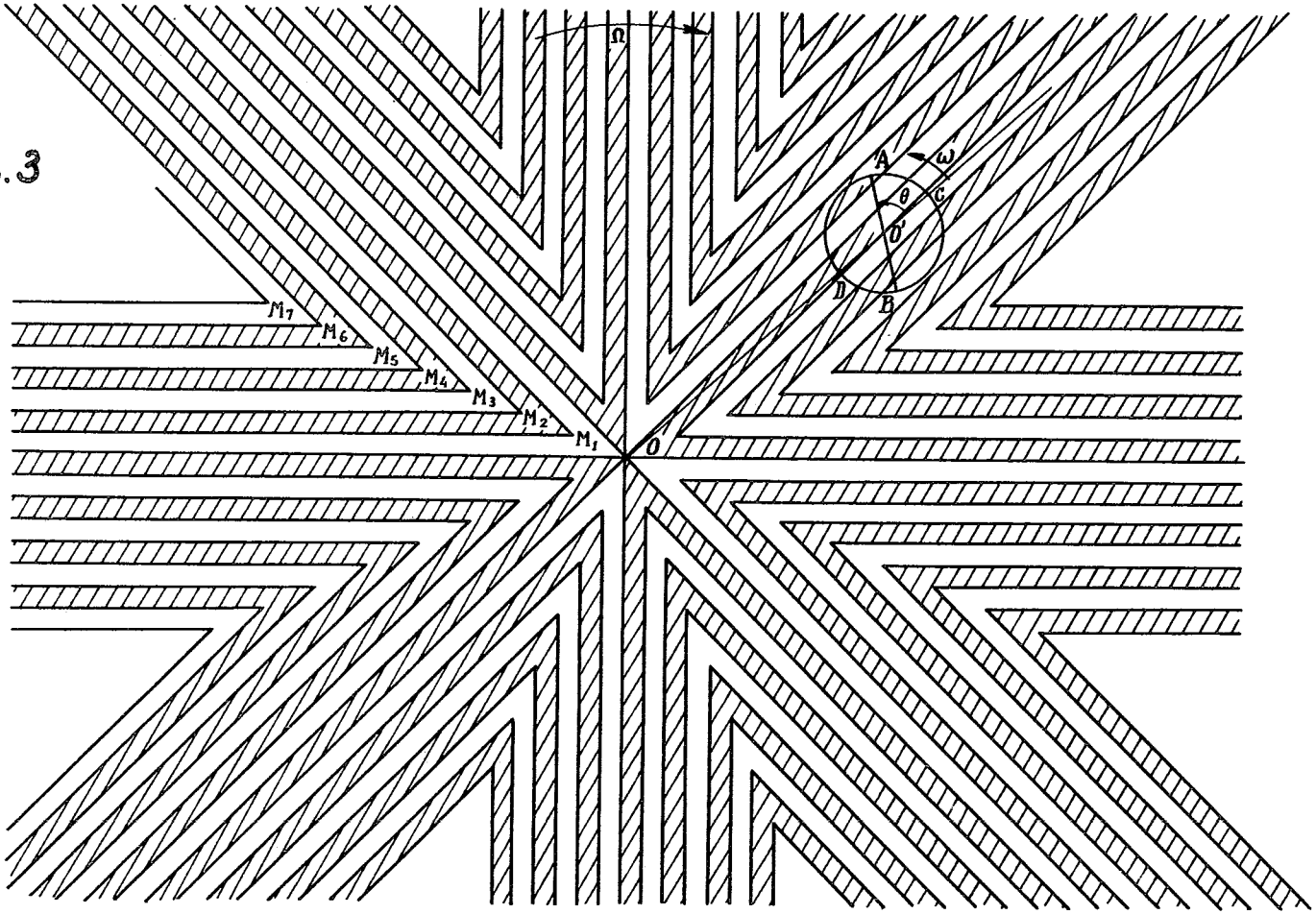
FIGS. 3, 4, 5 and 6 are views similar to FIG. 1 each showing a different form of beam which may be emitted by the radiation emitter.

Referring now to FIG. 3, there is shown a beam formed in a plane P located at a distance D from the radiation emitter. O designates the axis of the beam in the plane P. The latter is divided into $\mu$ equal angular sectors having their centers at O, $\mu$ preferably being an even whole number.

Starting at O, a plurality of points $M_1, M_2, \ldots M_k$ are marked on the $\mu$ bisections of the angular sectors so obtained, these points being such that:

$$OM_1 = M_1M_2 = \ldots M_{K-1}M_K = d.$$

Starting from the points $M_1, M_2 \ldots M_k$, lines are run parallel to the straight lines which delimit the angular sectors, and in this way there is defined a pattern formed by bands of equal width which define alternately areas of high and low radiation intensity.

In the embodiment illustrated in FIG. 3, the number $\mu$ of angular sectors is 8; the angle of the sectors is therefore:

$$\frac{2\pi}{\mu} = \frac{\pi}{4}$$

and the width of each of the bands is:

$$\epsilon = d \sin \frac{\pi}{\mu} = d \sin \frac{\pi}{8}$$

The radiation beam is caused to rotate about its own axis at an angular velocity of $\Omega$. When the beam executes a revolution, the number of alternations recorded by a detector A, located at a fixed point in space and situated at a distance from the center O of between (k-1)d and kd, is:

$$2(k-1)\mu$$

This number is therefore proportional to k and therefore to the distance from the center O.

To obtain the pattern shown in FIG. 3 and to project it into space, the above described method may be used, the beam being obtained by depositing a reflecting metallic coating, reproducing the form of the pattern on the outer face of the semi-reflecting glass of a laser resonance chamber.

To effect rotation of the beam, the laser resonance chamber can be rotated about its own axis. It is also possible simply to rotate a perforated disc and to project the image of this disc.

In a modified arrangement, use can be made of patterns different from the one described above with reference to FIG. 3. For example, instead of straight lines delimiting the angular sectors, use may also be made of curved lines, for example, helices.

Figure 4:
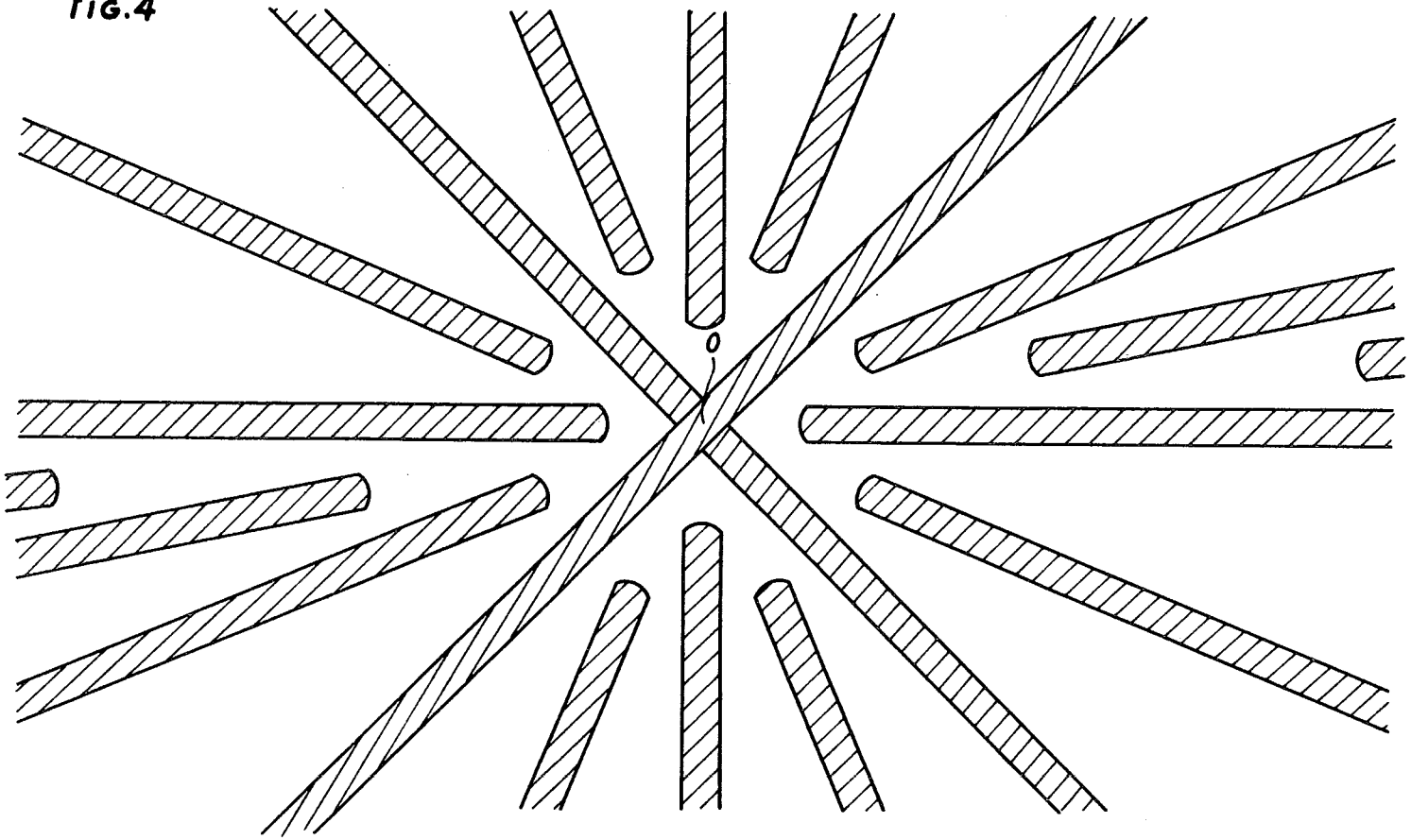

Also, as illustrated in FIG. 4, it is possible to use bands of equal width which define alternately areas of high and low radiation intensity and the axes of which pass through O.

In FIG. 3, the rotating body takes the form of a projectile having a center of rotation O' located at a distance of $\rho$ from O. The projectile is automatically rotating at an angular velocity of $\omega$. As in the previous embodiment, the projectile carries two radiation detectors A and B positioned one at each end of a diameter passing through the axis of rotation O' of the projectile.

Let it be assumed that: $AB = 2r$ (advantageously $r = d$)
$OO' = \rho$ $$\theta = \widehat{\overline{OO'}, BA}$$

$$\omega = \frac{d\theta}{dt}$$

The projectile rotates in the opposite direction to the direction of rotation of the beam, and $\omega \leqq \Omega$.

The speed of rotation $\Omega$ of the beam can be adjusted at the launching station so as to impart a well-defined value thereto. It is of advantage to use the greatest possible speed of rotation of the beam compatible with the response time of the detectors. The measurement procedures used on the projectile are based on this hypothesis.

In the projectile the time:

$$\Delta t = \frac{2\pi}{\Omega}$$

is memorized, this being the time required by the beam to execute one revolution.

Under these conditions, if $N_A$ and $N_B$ are the numbers of iso k circle crossings recorded by the detectors A and B during the time $$\Delta t = \frac{2\pi}{\Omega},$$

we then have $$\rho = \frac{d}{4}\left[\frac{N_a + N_B}{\mu}\right],$$

which is a close approximation to the actual value.

Figure 5:
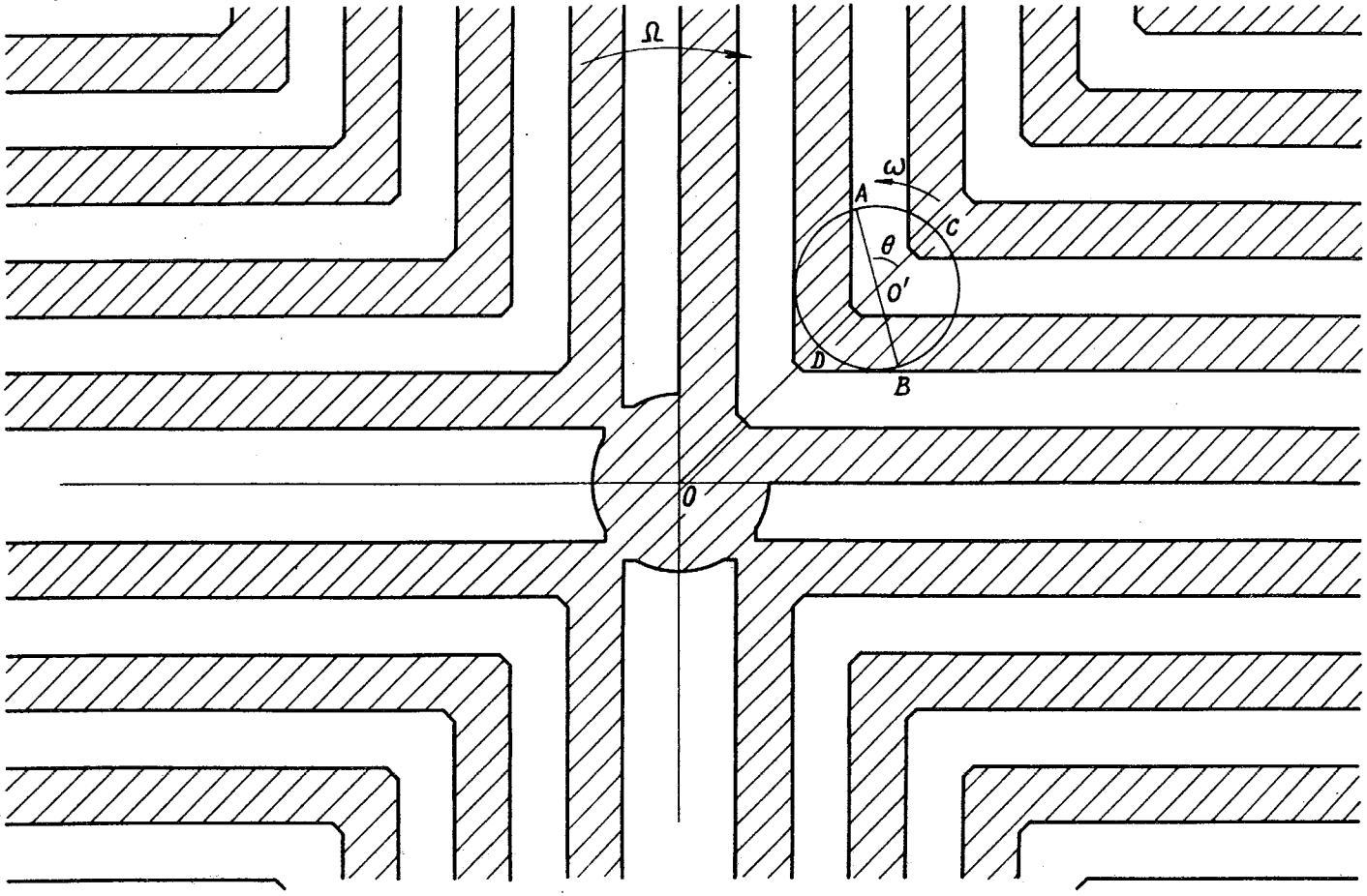

For this relationship also to be valid in the case where $\rho$ approximates to zero, the pattern at plane P is advantageously modified around the center so as to eliminate the crossings around the origin, as shown for example in FIG. 5. Still by way of example, the acute angles have been smoothed in this pattern so as to render the crossings more precise. (In this example $d=r$ and $\mu=4$).

Figure 6:
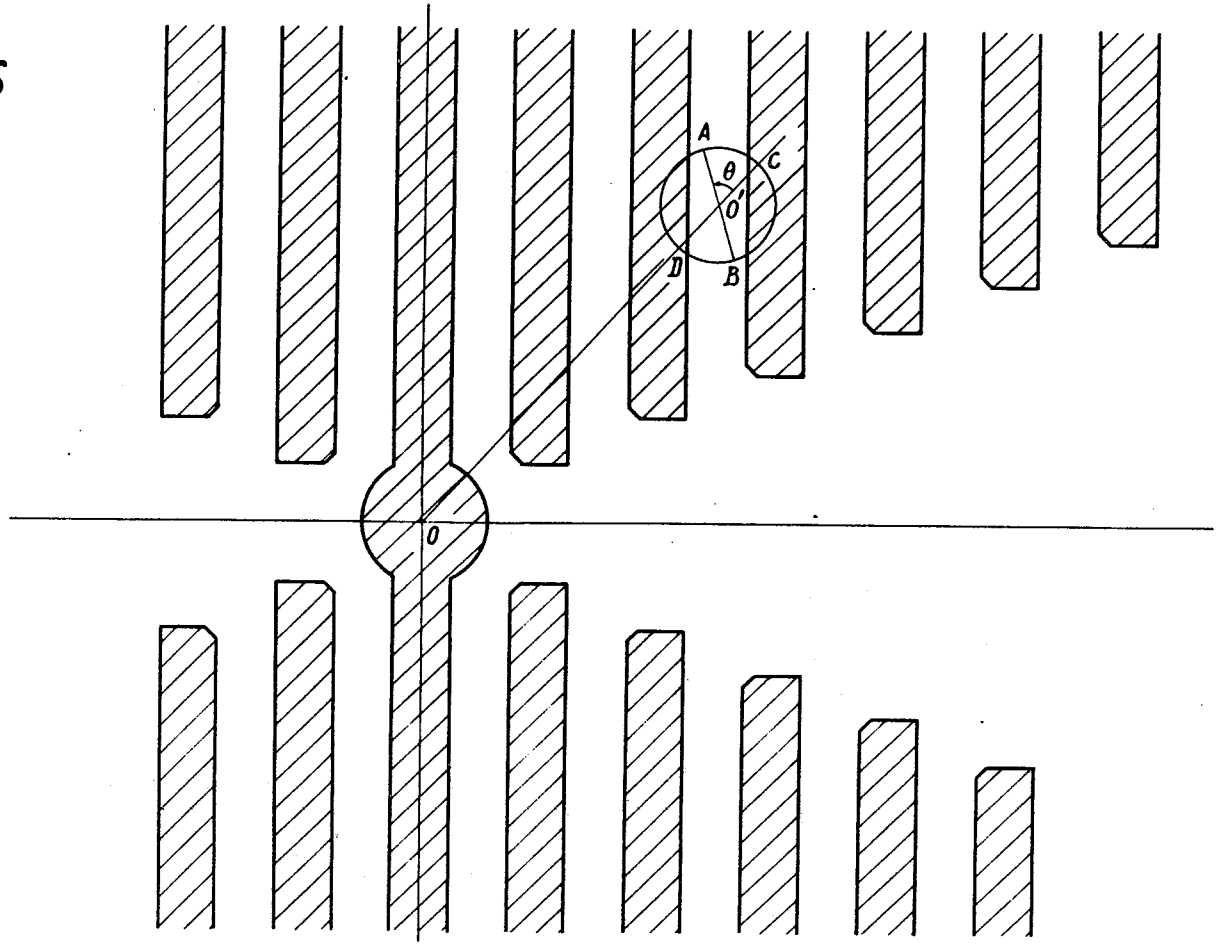

When a value of 2 is selected for $\mu$, it is preferable for the pattern to be slightly different from the theoretical form quoted above, so that the band k=0 straddles the origin as shown in FIG. 6.

Band 0 extends from $-\frac{d}{2}$ to $\frac{d}{2}$

Band 1 extends from $\frac{d}{2}$ to $\frac{3d}{2}$

Band $-1$ extends from $-\frac{d}{2}$ to $-\frac{3d}{2}$

Band $k$ extends from $\frac{kd}{2}$ to $\frac{k+2}{2}d$

Band $-k$ extends from $-\frac{kd}{2}$ to $-\frac{k+2}{2}d$

For the general formula also to apply when $\rho$ approximates 0, the central band will be modified again around the origin as shown in FIG. 6; it is also possible, for example, to interrupt the bands as shown in this same Figure so as to avoid tangential crossings.

The number of times, per second, that $\rho$ is likely to be determined is very high, say $$\frac{\Omega}{2\pi},$$

and it is possible to calculate from this a round figure for $\rho$ that is sufficiently accurate to enable $$\frac{d\rho}{dt}$$

to be calculated.

Also:

$$\cos\theta = \frac{N_A - N_B}{4r\mu}\cdot d$$

In particular, when $\cos\theta=1$, that is to say when the detector A is at C, then:

$$N_A - N_B = \frac{4r\mu}{d}$$

and when $$\theta = \frac{\pi}{2},$$

then: $N_A=N_B$.

This enables the moment $\tau$ at which the detector A reaches C to be determined.

Thus, by counting the number of crossings during a predetermined period, it is possible to obtain, on the projectile, data which enables it to be automatically guided toward the axis of the beam.

Figure 7:
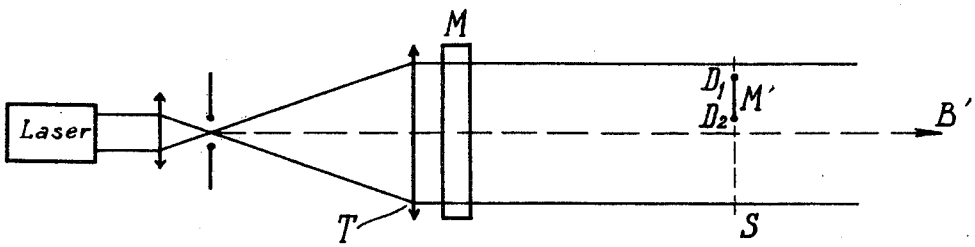
FIGS. 7 and 8 are diagrammatic views of a second embodiment of a radiation emitter for use in emitting the radiation beams illustrated in FIGS. 1, and 4 to 6.
Figure 8:
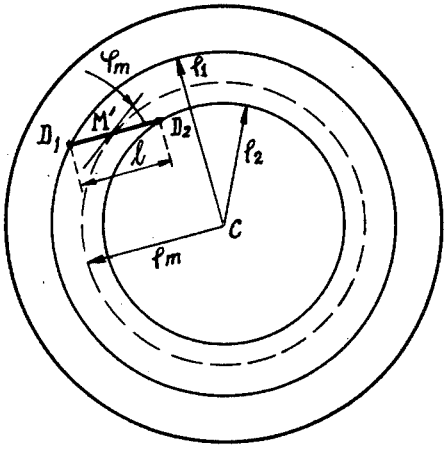

Referring now to FIGS. 7 and 8, a beam of electromagnetic radiation in the form of a laser beam is projected in space towards a target B' through a rotating aiming device M and a variable-focus optical system T in such manner that the cross-section S of the beam remains aligned with the projectile, represented by the line M' over the entire length of the trajectory. Pronounced rolling rotation is imparted to the projectile which carries two detectors D1 and D2 situated in a plane normal to its plane of maneuver. If the projectile has more than two planes of maneuvre, then more than two detectors are used.

As will be appreciated, the guiding system consists in calculating, in an axis system connected to the projectile (FIG. 8), the polar co-ordinates $\rho_m$ and $\tau_m$ of the position of the projectile in relation to the center C of the radiation beam, $\rho_m$ designating the distance of the axis of the projectile from the center of the beam, and $\rho_m$ the inclination of the maneuver center in relation to the radial passing through the axis of the projectile.

An "all or nothing" sighting signal is applied at a certain moment t starting from the point of passage through $\rho_m=0$, the extent of which is, for example, proportional to $$\rho_m - K\frac{\delta\rho m}{\delta t}$$

The values of $\rho_m$ and $\tau_m$ are determined in the following manner:

(a) the engraved marking on the sighting means M is such that the information received by the detectors is proportional to the radius; and (b) since the sighting means rotates at a speed very much greater than the speed of rolling rotation of the projectile, the detectors $D_1$ and $D_2$ of the latter provide information on the values of $\rho_1$ and $\rho_2$ such that:

$$\rho_m = \frac{\rho_1 + \rho_2}{2}$$

$$\phi_m = \arcsin\frac{\rho_1 + \rho_2}{l}$$

l being the distance between the two detectors $D_1$ and $D_2$.

In the various embodiments described above, the engraved pattern on the sighting means M takes the form of groups of fringes, and the values for $\rho_1$ and $\rho_2$ are read off by simply counting the impulses generated by the detectors when passing each fringe.

It has been found that the use of sighting means having fringes is accompanied by the following limitations:

(1) considerably quantification noise because of the limited number of fringes; and (2) difficulty in using a pulsed laser which introduces an additional quantification noise.

It is however an advantage to use a pulsed laser which permits considerable reduction in energy consumption and consequently in the weight and volume of a battery power supply, this being important in the case where the illuminating means is portable.

Consequently, in a modified form of the invention, the values for $\rho_1$ and $\rho_2$ provided by the detectors in the projectile are read off by counting chronological pulses applied during a validation gating pulse provided by each detector during the illumination period.

In a further modified form of the invention, use is made of a pulsed laser as the beam emitter, and the values of $\rho_1$ and $\rho_2$ are read off by counting pulses provided by the detector.

In yet another embodiment of the invention, the marking of the sighting means is achieved with the aid of a sector delimited by geometrical curves forming sectors of relatively great width varying with the distance from the center; such curves may for example be helices.

Figure 9:
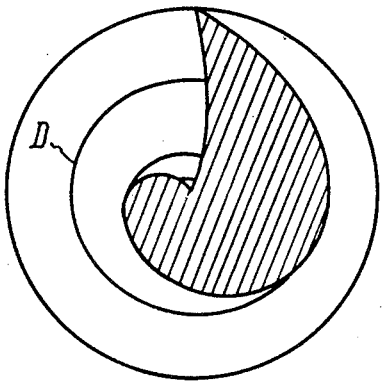
FIG. 9 is a diagrammatic view of a sighting device for use in forming the radiation beam.

FIG. 9 of the drawing shows an example of a sighting device having a helical sector.

This Figure shows at D the line of a projectile detector in the plane of the cross-section of the beam. As indicated above, the values for $\rho_1$ and $\rho_2$ are read off by a time count, or to be more precise by counting the difference between the bright periods and the dark periods which are a function of the distance $\rho$.

The use of a sighting means having a helical sector permits the use of a pulsed laser and reduces the quantification noise.

In the system described above, the launching station is particularly simple, and certain of its elements can be used for other purposes.

The launching station mainly comprises the emitter together with its variable-focus optical system which, during firing, will generally be programmed to the theoretical rate of travel of the projectile. If necessary a telemeter measuring the distance travelled by the moving body may be used to control the optical system. Before firing, the optical system will be in a position corresponding to the take-over distance $D_{min}$, and its field at its widest. The emitter then illuminates almost uniformly that area contained in its field beyond the distance $D_{min}$.

Use can also be made of a television camera, sensitive to the radiation from the emitter and provided with a crossed-line grid, for carrying out observation during the day and at night and for triggering the launch when the target is within firing range.

If necessary, by adjusting the variable focus the gunner is able to measure approximately the distance to the target by focusing the rings on to the latter. At the same time he is able to check and adjust the coincidence of the crossed lines of the grid and the axis of the beam.

An ordinary telescope operating in synchronism with the two above-mentioned items of equipment can of course complete the launching station and facilitate day-time observation, and it may even replace the television camera.

A launching station of this kind enables a corrected shell, a missile or any other ballistic device to be fired.

It will be seen that the above described apparatus enables gyroscopes to be dispensed with on the guided moving body, and this offers the following advantages:

1 It is not necessary to impart a predetermined rolling position to the moving body at its launching station or in its launching tube, since there is no gyroscope to be rammed home; the slope of the launching station is no longer of importance, and the locking means can be considerably simplified or even dispensed with.

2 In moving bodies fitted with gyroscopes it is necessary to provide an electrical or mechanical connection between the moving body and the launching station so as to trigger off and release the gyroscope before firing; in the system described above the electrical connections between the guided moving body and the launching station can be eliminated.

3 In the conventional missiles the gyroscope is an element which limits the possible initial acceleration. It is however necessary to be able to increase acceleration in the launching tube or on the launching platform so as to obtain the highest possible muzzle velocity. Acceleration through the air is in fact an important cause of dispersion which often makes it difficult for the guiding system to take over, and in any case reduces accuracy at short ranges.

Other items provided in the moving body, e.g. batteries, electronic or optical components, rudder controls etc. can be disposed or designed in such a way as to withstand accelerations of several thousand g so that a muzzle velocity, well into the supersonic range, is achieved. Up to take-over and alignment, there is advantage in that the thrust of the crusing propeller, if present, balances drag in the best possible way so as to minimize dispersion. Also the apparatus described above is not affected by jamming known to occur at present.

This invention may also be applicable in certain fields in land-surveying where it is required to sight the position of an axis.

What we claim is:

1. An apparatus for guiding a self rotating projectile of the type including a launching means to keep the projectile on course toward a target, said apparatus comprising:

a radiation emitter adapted to be located on the launching means of a self-rotating projectile to be guided for emitting a beam of very short wavelength electromagnetic radiation;

an amplitude modulation means located in the path of said beam of radiation including a grid having alternate opaque and transparent portions rotating in a direction opposite the rotation of the projectile for producing a rotating pattern of alternate high and low intensity radiation;

a variable focal length optical system located in the path of said beam of radiation for focusing said rotating pattern of alternate high and low intensity radiation in a plane containing the projectile as it moves;

two electromagnetic radiation detectors adapted to be mounted on the self rotating projectile for receiving said beam of radiation each including a convergent lens and an electromagnetic cell at the focus of said convergent lens for producing a detection signal dependent on the intensity of electromagnetic radiation thereon; and a control means adapted to be mounted on the self rotating projectile and connected to said pair of electromagnetic radiation detectors for receiving said detection signals, for determining the distance and direction of the self rotating projectile from the axis of said beam of radiation in a coordinate system fixed on the projectile and for controlling the trajectory of the self rotating projectile to follow the axis of said beam of radiation.

2. An apparatus according to claim 1, wherein said radiation emitter includes a laser, and said grid of said amplitude modulation means comprises a deposit of a reflecting metallic coating, in the form of a plurality of concentric rings, on the outer face of the semi-reflecting glass of the resonance chamber of said laser.

3. An apparatus according to claim 2 wherein said amplitude modulation means further comprises a metallic semi-reflecting coating deposited on the inner face of the glass of the laser resonance chamber, the glass having a predetermined thickness for the establishment of a system of standing waves between the two metallic coatings wherein the vibration node is within the metal.

4. An apparatus according to claim 1 wherein said variable focal length optical system further comprises means for correcting geometrical aberrations.

5. An apparatus according to claim 1 wherein said electromagnetic radiation detectors further comprise a filter for passing only monochromatic radiation.

6. An apparatus according to claim 1 further comprising a time base generator adapted to be mounted on said self rotating projectile and connected to said control means for generating a time base signal and wherein said control means receives said time base signal for use in determining the position and controlling the trajectory of said self rotating projectile.

7. An apparatus according to claim 1 further comprising a telescope adapted to be located on the launching means having crossed lines which coincide with the axis of the beam and for permitting observation and firing during daytime.

8. An apparatus according to claim 1 wherein said radiation emitter comprises a laser and said amplitude modulation means comprises rotation means for causing the resonance chamber of said laser to rotate about its own axis for causing the emitted radiation beam to rotate.

9. An apparatus according to claim 1 wherein said amplitude modulation means comprises an apertured disc through which the radiation beam is projected and a rotation means for rotating said apertured disc for causing the image of the disc projected by the radiation to rotate.

10. An apparatus for guiding a self rotating projectile of the type including a launching means to keep the projectile on course toward a target, said apparatus comprising:

a radiation emitter adapted to be located on the launching means of a self-rotating projectile to be guided for emitting a beam of very short wavelength electromagnetic radiation;

an amplitude modulating means located in the path of said beam of radiation including a grid having alternate opaque and transparent portions rotating in a direction opposite the rotation of the projectile for producing a rotating pattern of alternate high and low intensity radiation;

a variable focal length optical system located in the path of said beam of radiation for focusing said rotating pattern of alternate high and low intensity radiation in a plane containing the projectile as it moves;

two electromagnetic radiation detectors adapted to be mounted on the self rotating projectile for receiving said beam of radiation each including a convergent lens and an electromagnetic cell at the focus of said convergent lens for producing a detection signal dependent on the intensity of electromagnetic radiation thereon;

two identical accelerometers adapted to be mounted on said self rotating projectile disposed symmetrically in relation to the main longitudinal axis of inertia of said projectile for producing acceleration signals; and a control means adapted to be mounted on the self rotating projectile and connected to said pair of electromagnetic radiation detectors and said two identical accelerometers for receiving said detection signals, for determining the distance and direction of the self rotating projectile from the axis of said beam of radiation and for controlling the trajectory of the self rotating projectile to follow the axis of said beam of radiation.

11. An apparatus for guiding a self rotating projectile of the type including a launching means to keep the projectile on course toward a target, said apparatus comprising:

a radiation emitter adapted to be located on the launching means of a self rotating projectile to be guided for emitting a beam of very short wavelength electromagnetic radiation;

an amplitude modulation means located in the path of said beam of radiation including a grid having alternate opaque and transparent portions rotating in a direction opposite the rotation of the projectile for producing a rotating pattern of alternate high and low intensity radiation;

a variable focal length optical system located in the path of said beam of radiation for focusing said rotating pattern of alternate high and low intensity radiation in a plane containing the projectile as it moves;

a telemeter adapted to be located on the launching means and connected to said variable focal length optical system for measuring the distance to said self rotating projectile and for controlling the focal length of the variable focal length optical system;

two electromagnetic radiation detectors adapted to be mounted on the self rotating projectile for receiving said beam of radiation each including a convergent lens and an electromagnetic cell at the focus of said convergent lens for producing a detection signal dependent on the intensity of electromagnetic radiation thereon; and a control means adapted to be mounted on the self rotating projectile and connected to said pair of electromagnetic radiation detectors for receiving said detection signals, for determining the distance and direction of the self rotating projectile from the axis of said beam of radiation in a coordinate system fixed on the projectile and for controlling the trajectory of the self rotating projectile to follow the axis of said beam of radiation.

12. An apparatus for guiding a self rotating projectile of the type including a launching means to keep the projectile on course toward a target, said apparatus comprising:

a radiation emitter adapted to be located on the launching means of a self rotating projectile to be guided for emitting a beam of very short wavelength electromagnetic radiation;

an amplitude modulation means located in the path of said beam of radiation including a grid having alternate opaque and transparent portions rotating in a direction opposite the rotation of the projectile for producing a rotating pattern of alternate high and low intensity radiation;

a variable focal length optical system located in the path of said beam of radiation for focusing said rotating pattern of alternate high and low intensity radiation in a plane containing the projectile as it moves;

a television camera adapted to be located on the launching means sensitive to the radiation emitted by said radiation emitter having a cross-line grid for permitting day and night observation and for enabling the shot to be triggered when the target is within firing range;

two electromagnetic radiation detectors adapted to be mounted on the self rotating projectile for receiving said beam of radiation each including a convergent lens and an electromagnetic cell at the focus of said convergent lens for producing a detection signal dependent on the intensity of electromagnetic radiation thereon; and a control means adapted to be mounted on the self rotating projectile and connected to said pair of electromagnetic radiation detectors for receiving said detection signals, for determining the distance and direction of the self rotating projectile from the axis of said beam of radiation in a coordinate system fixed on the projectile and for controlling the trajectory of the self rotating projectile to follow the axis of said beam of radiation.

* * * * *